US006965362B1

(12) United States Patent
Ishizuka

(10) Patent No.: US 6,965,362 B1
(45) Date of Patent: Nov. 15, 2005

(54) APPARATUS AND METHOD FOR DRIVING LIGHT EMITTING PANEL

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 985 days.

(21) Appl. No.: 09/593,791

(22) Filed: Jun. 13, 2000

(30) Foreign Application Priority Data

Jun. 15, 1999 (JP) ..... 11-167717

(51) Int. Cl.[7] ..... G09G 3/32
(52) U.S. Cl. ..... 345/82; 345/55; 345/76; 315/169.1
(58) Field of Search ..... 345/82, 74, 76, 345/77, 74.1, 36, 55; 315/169.1, 169.2, 169.4

(56) References Cited

U.S. PATENT DOCUMENTS 4,888,523 A * 12/1989 Shoji et al. ..... 315/169.3
5,283,556 A 2/1994 Ise
5,294,870 A 3/1994 Tang et al.
5,311,169 A * 5/1994 Inada et al. ..... 345/77
5,448,024 A 9/1995 Kawaguchi et al.
5,565,733 A 10/1996 Krafcik et al.
5,708,483 A * 1/1998 Asai ..... 349/38
5,712,652 A * 1/1998 Sato et al. ..... 345/90
5,892,504 A * 4/1999 Knapp ..... 345/204
6,369,786 B1 * 4/2002 Suzuki ..... 345/77

* cited by examiner

*Primary Examiner*—Xiao Wu
*Assistant Examiner*—Abbas Abdulselam
(74) *Attorney, Agent, or Firm*—Morgan Lewis & Bockius LLP

(57) ABSTRACT

An apparatus for driving a light emitting panel which selects one scanning line from a plurality of scanning lines, designates at least one drive line of a plurality of drive lines corresponding to at least one capacitive light emitting element driven to emit light on the one scanning line, applies the one scanning line with a first predetermined potential, applies scanning lines other than the one scanning line with a second predetermined potential higher than the first predetermined potential, supplies a driving current to the at least one line so as to apply the at least one capacitive light emitting element with a positive voltage equal to or higher than a light emission threshold voltage in the forward direction, and applies drive lines other than the at least one drive line with a third predetermined voltage lower than the light emission threshold voltage and higher than the first predetermined potential.

5 Claims, 7 Drawing Sheets

APPARATUS AND METHOD FOR DRIVING LIGHT EMITTING PANEL

BACKGROUND OF THE INVENTION

1. Field of the Invention

The present invention relates to an apparatus and method for driving a light emitting panel using capacitive light emitting elements such as organic electroluminescence elements or the like.

2. Description of the Related Background Art

In recent years, with the trend of increasing the size of display devices, thinner display devices have been required, and a variety of thin display devices have been brought into practical use. An electroluminescence display comprising a plurality of organic electroluminescence elements arranged in a matrix has drawn attention as one of the thin display devices.

The organic electroluminescence element (hereinafter simply called the "EL element" as well) may be electrically represented as an equivalent circuit as illustrated in FIG. 1. As can be seen from the figure, the element can be replaced with a circuit configuration having a capacitive component C and a component E of a diode characteristic coupled in parallel with the capacitive component. Thus, the EL element can be regarded as a capacitive light-emitting element. As the EL element is applied with a direct current light-emission driving voltage across the electrodes, a charge is accumulated in the capacitive element C. Subsequently, when the applied voltage exceeds a barrier voltage or a light emission threshold voltage inherent to the element, a current begins flowing from one electrode (on the anode side of the diode component E) to the organic functional layer which carries the light emitting layer so that light is emitted therefrom at an intensity proportional to the current.

The Voltage V-Current I-Luminance L characteristic of the element is similar to the characteristic of a diode, as illustrated in FIG. 2. Specifically, the current I is extremely small at a light emission threshold voltage Vth or lower, and sharply increases as the voltage increases to the light emission threshold voltage Vth or higher. The current is substantially proportional to the luminance L. Such an element, when applied with a driving voltage exceeding the light emission threshold voltage Vth, exhibits a light emission luminance in proportion to a current corresponding to the applied driving voltage. On the other hand, the light emission luminance remains equal to zero when the driving voltage applied to the element is at the light emission threshold voltage Vth or lower which does not cause the driving current to flow into the light emitting layer.

As a method of driving a display panel using a plurality of EL elements, a simple matrix driving system is known. FIG. 3 illustrates the structure of a driver applied with the simple matrix driving system. In a light emitting panel, n cathode lines (metal electrodes) $B_1$ –$B_n$ are arranged extending in parallel in the horizontal direction, and m anode lines (transparent electrodes) $A_1$–$A_m$ are arranged extending in parallel in the vertical direction. At each portion where the cathode lines and the anode lines (a total of n×m locations) intersect, an EL element $E_{1,1}$–$E_{m,n}$ is formed. The elements $E_{1,1}$–$E_{m,n}$ which carry pixels are arranged in matrix, at the intersections of the anode lines $A_1$–$A_m$ along the vertical direction and the cathode lines $B_1$–$B_n$ along the horizontal direction. The elements $E_{1,1}$–$E_{m,n}$ have one end connected to an anode line (on the anode line side of the diode component E in the aforementioned equivalent circuit) and the other end connected to a cathode line (on the cathode line side of the diode component E in the aforementioned equivalent circuit). The cathode lines are connected to a cathode line scanning circuit 1, while the anode lines are connected to an anode line drive circuit 2.

The cathode line scanning circuit 1 has scanning switches $\mathbf{5}_1$–$\mathbf{5}_n$ corresponding to the cathode lines $B_1$–$B_n$ for individually determining potentials thereon. Each of the scanning switches $\mathbf{5}_1$–$\mathbf{5}_n$ supplies a corresponding cathode line either with a positive potential $V_{CC}$ (for example, 10 volts) or with a ground potential (0 volt).

The anode line drive circuit 2 has current sources $\mathbf{2}_1$–$\mathbf{2}_m$ (for example, constant current sources) and drive switches $\mathbf{6}_1$–$\mathbf{6}_m$ corresponding to the anode lines $A_1$–$A_m$ for individually supplying the EL elements with driving currents. Each of the drive switches $\mathbf{6}_1$–$\mathbf{6}_m$ is adapted to supply an associated anode line with the output of the current source $\mathbf{2}_1$–$\mathbf{2}_m$ or a ground potential. Each of the current sources $\mathbf{2}_1$–$\mathbf{2}_m$ has an amount of supply current which is required to maintain light emitting of the EL elements at desired instantaneous luminance (hereinafter this state is called the "steady light emitting state"). Also, When an EL element is in the steady light emitting state, the aforementioned capacitive component C of the EL element is charged, so that the voltage across both terminals of the element becomes a positive value Ve (hereinafter, this value is called the "light emission regulating voltage") slightly higher than a light emitting threshold voltage Vth. It should be noted that when voltage sources are used as driving sources, their driving voltages are set to be equal to Ve.

The cathode line scanning circuit 1 and the anode line drive circuit 2 are connected to a light emission control circuit 4.

The light emission control circuit 4 controls the cathode line scanning circuit 1 and the anode line drive circuit 2 in accordance to image data supplied from an image data generating system, not shown, so as to display an image represented by the image data. The light emission control circuit 4 generates a scanning line selection control signal for controlling the cathode line scanning circuit 1 to switch the scanning switch $\mathbf{5}_1$–$\mathbf{5}_n$ such that any of the cathode lines corresponding to a horizontal scanning period of the image data is selected and set at the ground potential, and the remaining cathode lines are applied with the positive potential $V_{CC}$. The positive potential $V_{CC}$ is applied by regulated voltage sources connected to cathode lines in order to prevent crosstalk light emission from occurring in EL elements connected to intersections of a driven anode line and cathode lines which are not selected for scanning. The positive potential $V_{CC}$ is typically set equal to the light emission regulating voltage Ve ($V_{CC}$=Ve). As the scanning switches $\mathbf{5}_1$–$\mathbf{5}_n$ are sequentially switched to the ground potential in each horizontal scanning period, a cathode line set at the ground potential functions as a scanning line which enables the EL elements connected thereto to emit light.

The anode line drive circuit 2 conducts a light emission control for the scanning lines as mentioned above. The light emission control circuit 4 generates a drive control signal (driving pulse) in accordance with pixel information. The drive control signal is a signal for instructing which of EL elements connected to associated scanning lines are driven to emit light at which timing and for approximately how long, and supplies the drive control signal to the anode line drive circuit 2. The anode line drive circuit 2, responsive to this drive control signal, individually controls the switching of the drive switches $\mathbf{6}_1$–$\mathbf{6}_m$ to supply driving currents to associated EL elements through the anode lines $A_1$–$A_m$ in accordance with the pixel information. Thus, the EL elements supplied with the driving currents are forced to emit light in accordance with the pixel information.

Next, the light emitting operation will be described with reference to an example illustrated in FIGS. 3 and 4. This light emitting operation is taken as an example in which a cathode line $B_1$ is scanned to have EL elements $E_{1,1}$ and $E_{2,1}$ emit light, and subsequently, a cathode line $B_2$ is scanned to have EL elements $E_{2,2}$ and $E_{3,2}$ emit light. Also, for facilitating the understanding of the explanation, in FIGS. 3 and 4, an EL element which is emitting light is represented by a diode symbol, while an element which is not emitting light is represented by a capacitor symbol.

Referring first to FIG. 3, only a scanning switch $\mathbf{5}_1$ is switched to the ground potential equal to zero volt to scan a cathode line $B_1$. The remaining cathode lines $B_2$–$B_n$ are applied with the positive potential VCC through the scanning switches $\mathbf{5}_2$–$\mathbf{5}_n$. Simultaneously, anode lines $A_1$ and $A_2$ are connected to current sources $\mathbf{2}_1$ and $\mathbf{2}_2$ through drive switches $\mathbf{6}_1$ and $\mathbf{6}_2$, respectively. The remaining anode lines $A_3$–$A_m$ are switched to the ground potential at zero volt through drive switch $\mathbf{6}_3$–$\mathbf{6}_m$. Thus, in this event, only the EL elements $E_{1,1}$ and $E_{2,1}$ are forward biased so that driving currents flow thereinto from the current sources $\mathbf{2}_1$ and $\mathbf{2}_2$ as indicated by arrows, causing only the EL elements $E_{1,1}$ and $E_{2,1}$ to emit light. In this state, the EL elements $E_{3,2}$ and $E_{m,n}$ which are not emitting light, indicated by hatching, are charged with polarities as indicated in the drawing.

From the light emitting state illustrated in FIG. 3, only the scanning switch $\mathbf{5}_2$ corresponding to the cathode line $B_2$ is now switched to the ground potential at zero volt to scan the cathode line $B_2$ as illustrated in FIG. 4. Simultaneously with this scanning, the current sources $\mathbf{2}_2$, $\mathbf{2}_3$ are connected to the corresponding anode lines $A_2$, $A_3$ through the drive switches $\mathbf{6}_2$, $\mathbf{6}_3$, while the remaining anode lines $A_1$, $A_4$–$A_m$ are applied with zero volt through the drive switches $\mathbf{6}_1$, $\mathbf{6}_4$–$\mathbf{6}_m$, respectively. Thus, in this event, only the EL elements $E_{2,2}$, $E_{3,2}$ are forward biased, so that driving currents flow into the EL elements $E_{2,2}$, $E_{3,2}$ from the current sources $\mathbf{2}_2$, $\mathbf{2}_3$ as indicated by arrows, causing only the EL elements $E_{2,2}$, $E_{3,2}$ to emit light.

In the light emitting control as described above, a scanning mode that is a period in which any of the cathode lines $B_1$–$B_n$ is activated is repeated. The scanning mode is performed every one horizontal scanning period (1H) of image data, wherein the scanning switches $\mathbf{5}_1$–$\mathbf{5}_n$ are sequentially switched to the ground potential every horizontal scanning period. The light emission control circuit 4 generates a drive control signal (driving pulse) in accordance with pixel information. The drive control signal instructs which of EL elements connected to associated scanning lines are driven to emit light at which timing and for approximately how long, and is supplied to the anode line drive circuit 2. The anode line drive circuit 2, responsive to the drive control signal, controls the switching of the drive switches $\mathbf{6}_1$–$\mathbf{6}_m$ to supply driving currents to associated EL elements according to the pixel information through the anode lines $A_1$–$A_m$. Thus, the EL elements supplied with the driving currents perform light emitting corresponding to the pixel information.

During a period in which the cathode line $B_1$ is selected and driven at the ground potential, EL elements $E_{3,2}$–$E_{m,n}$ are applied with the voltage Vcc in the direction opposite to the forward direction to prevent EL elements on non-selected scanning lines from emitting light to cause crosstalk, so that the EL elements $E_{3,2}$–$E_{m,n}$ are charged.

However, since the charge accumulated in the reverse direction for purposes of preventing the crosstalk light emission is a charge which never contributes to light emission, useless power is consumed.

Also, immediately after the scanning is switched from the cathode line $B_1$ to the cathode line $B_2$, the EL element $E_{3,2}$, which is one of the charged EL elements, has the anode connected to the current source $\mathbf{2}_3$ through the drive switch $\mathbf{6}_3$, and the cathode driven to the ground potential through the scanning switch $\mathbf{5}_2$, so that the EL element $E_{3,2}$ should emit light. However, unless the charge accumulated on the EL element $E_{3,2}$ in the reverse direction has been discharged, the EL element $E_{3,2}$ is not immediately applied with a voltage exceeding the light emission threshold voltage Vth in the forward direction. Therefore, there is a problem that a delay occurs before the EL element $E_{3,2}$ actually emits light.

SUMMARY OF THE INVENTION

It is therefore an object of the present invention to provide an apparatus and method for driving a light emitting panel using capacitive light emitting elements, which are capable of reducing power consumption that does not contribute to light emission and improving the light emission starting characteristic.

An apparatus for driving a light emitting panel according to the present invention is adapted for use with a light emitting panel including a plurality of drive lines and a plurality of scanning lines intersecting with each other, and a plurality of capacitive light emitting elements each having a polarity and connected between one of the scanning line and one of the drive line at an intersecting position of the one scanning line and the one drive line. The driving apparatus comprises control means for selecting one scanning line from the plurality of scanning lines in accordance with a scanning timing of an input video data, and for designating at least one drive line of the plurality of drive lines corresponding to at least one capacitive light emitting element driven to emit light on the one scanning line in accordance with the input video data; means for applying the one scanning line with a first predetermined potential, and for applying scanning lines other than the one scanning line with a second predetermined potential higher than the first predetermined potential; and means for supplying a driving current to the at least one drive line so as to apply the at least one capacitive light emitting element with a positive voltage equal to or higher than a light emission threshold voltage in the forward direction, and for applying drive lines other than the at least one drive line with a third predetermined voltage lower than the light emission threshold voltage and higher than the first predetermined potential.

Also, a driving method according to the present invention is adapted for use with a light emitting panel which includes a plurality of drive lines and a plurality of scanning lines intersecting with each other, and a plurality of capacitive light emitting elements each having a polarity and connected between one of the scanning line and one of the drive line at an intersecting position of the one scanning line and the one drive line. The driving method comprises the steps of selecting one scanning line from the plurality of scanning lines in accordance with a scanning timing of an input video data; designating at least one drive line corresponding to at least one capacitive light emitting element driven to emit light on the one scanning line in accordance with the input video data; applying the one scanning line with a first predetermined potential; applying scanning lines other than the one scanning line with a second predetermined potential higher than the first predetermined potential; supplying a driving current to the at least one drive line so as to apply the at least one capacitive light emitting element with a positive voltage equal to or higher than a light emission threshold voltage in a forward direction; and applying drive lines other than the at least one drive line with a third predetermined voltage lower than the light emission threshold voltage and higher than the first predetermined potential.

According to the present invention as described above, while capacitive light emitting elements other than the at least one capacitive light emitting element is applied with a voltage equal to a potential difference between the second predetermined potential and the third predetermined potential and charged thereby in order to prevent light emission which causes crosstalk, the amount of accumulated charge by the charging is sufficiently small, so that it is possible to reduce power consumption that does not contribute to light emission, as compared with the prior art apparatus, when the same light emitting operation is performed. In addition, since the amount of accumulated charge is so small that it is promptly discharged when the capacitive light emitting element transitions from a non-light emitting state to a light emitting state, the light emission starting characteristic can be improved.

DETAILED DESCRIPTION OF THE PREFERRED EMBODIMENT

An embodiment of the present invention will hereinafter be described in detail with reference to the accompanying drawings.

Figure 5:
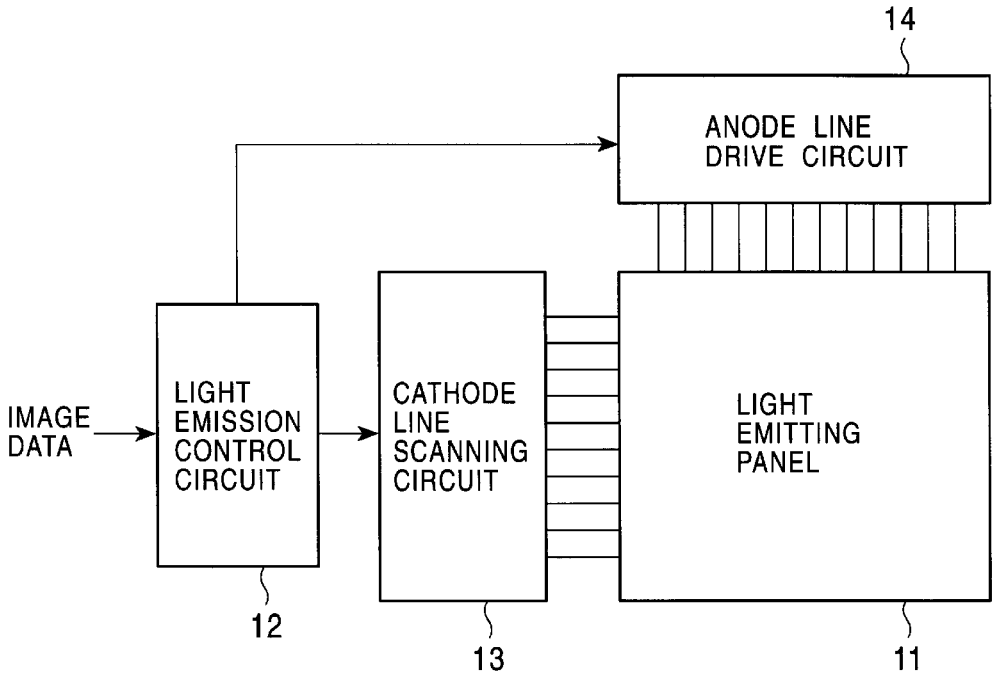
FIG. 5 is a block diagram generally illustrating the configuration of a driving apparatus according to the present invention.

FIG. 5 illustrates a general configuration of a display device according to one embodiment of the present invention which uses organic electroluminescence elements as capacitive light emitting elements. The display device has a capacitive light emitting panel 11 and a light emission control circuit 12.

Figure 1:
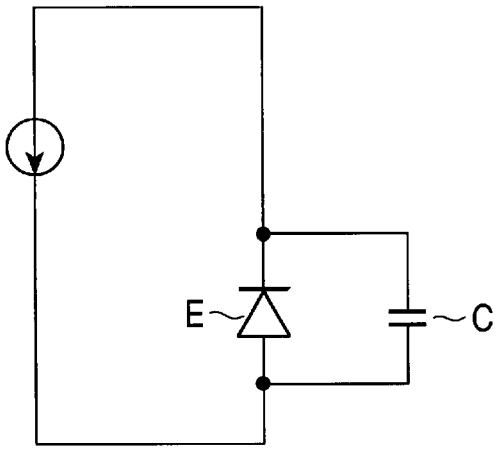
FIG. 1 is a diagram illustrating an equivalent circuit of an organic electroluminescence element.
Figure 2:
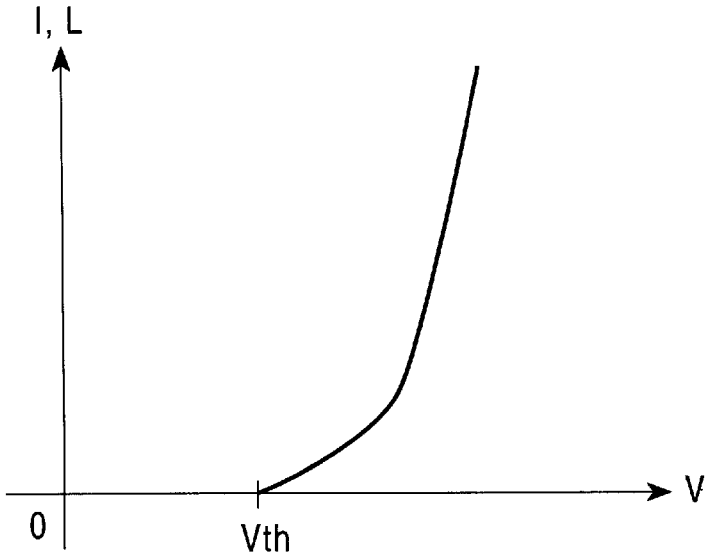
FIG. 2 is a diagram generally illustrating the driving voltage-current-emitted light luminance characteristic of the organic electroluminescence element.
Figure 3:
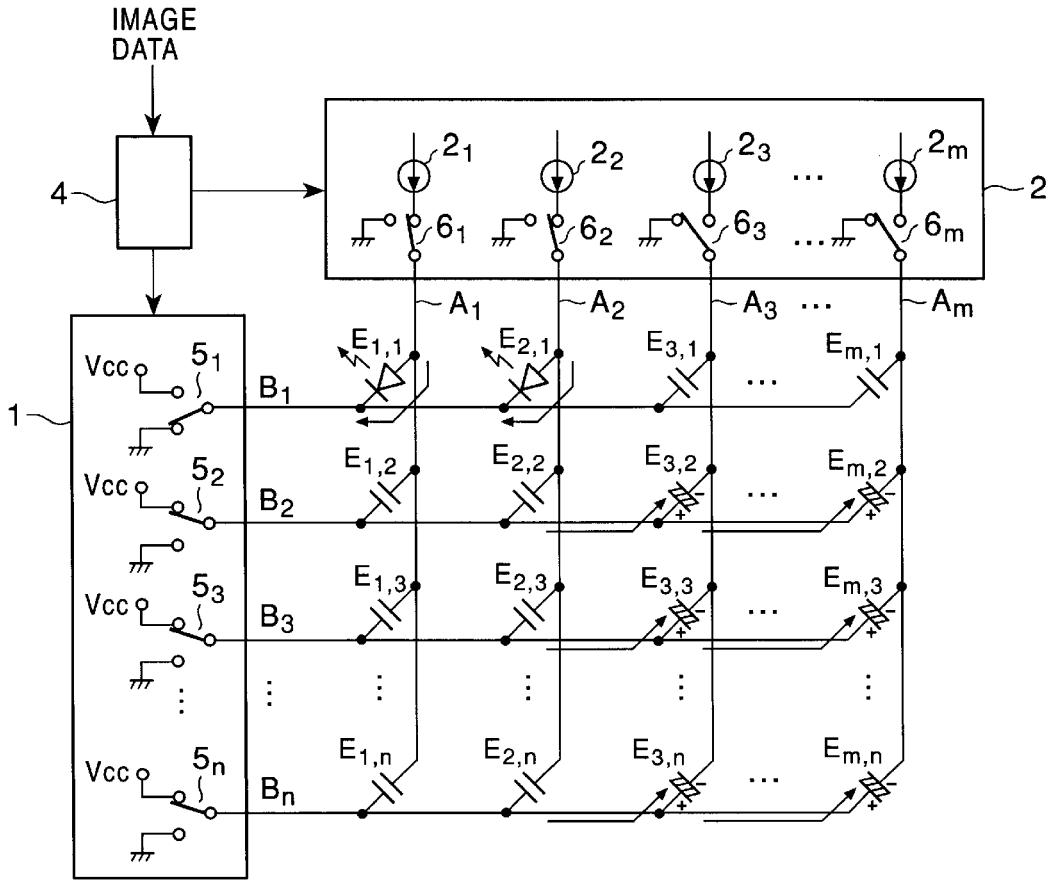
FIGS. 3 and 4 are block diagrams for explaining the operation of a conventional driving apparatus.
Figure 4:
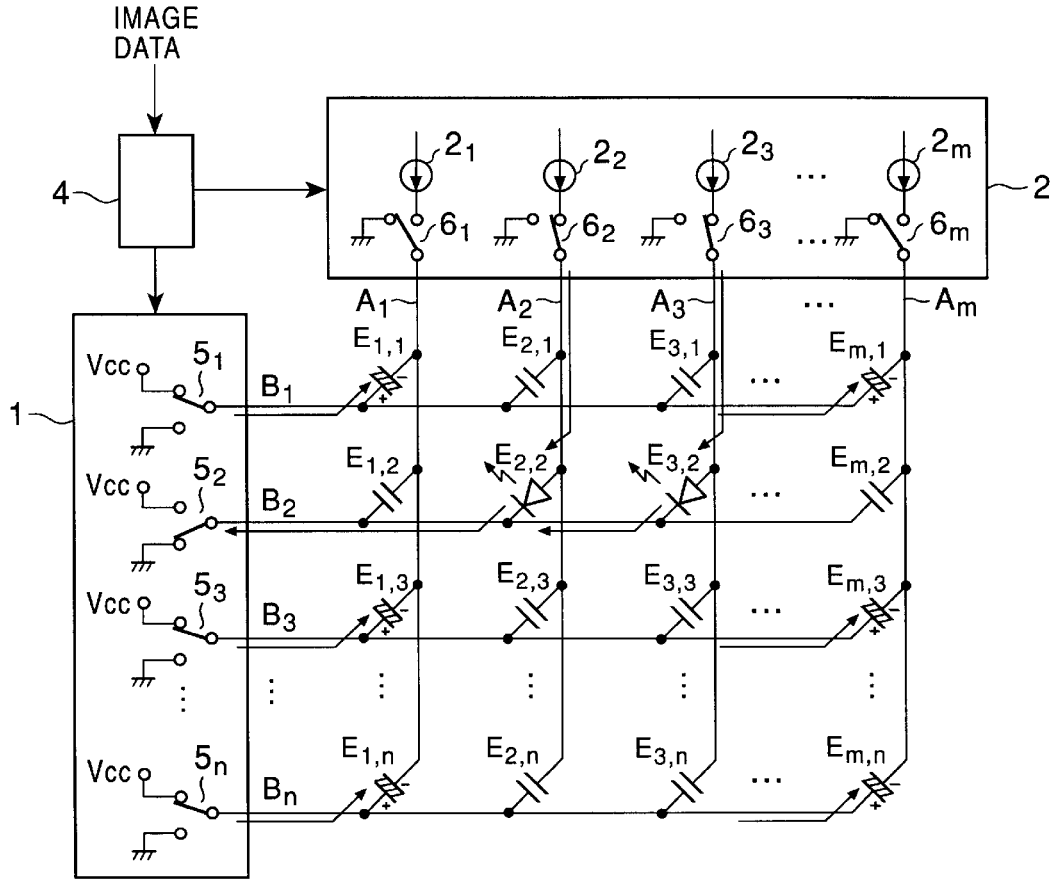
Figure 7:
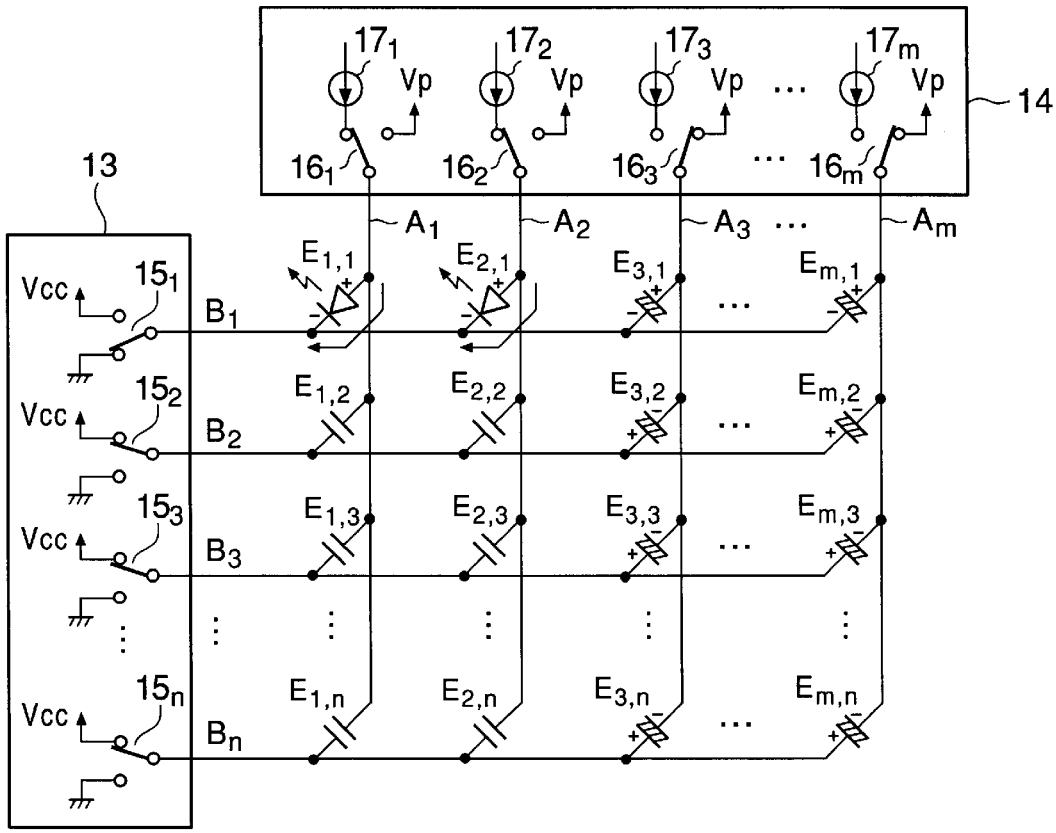
FIGS. 7 and 8 are block diagrams for explaining the operation of the driving apparatus of FIG. 5.
Figure 8:
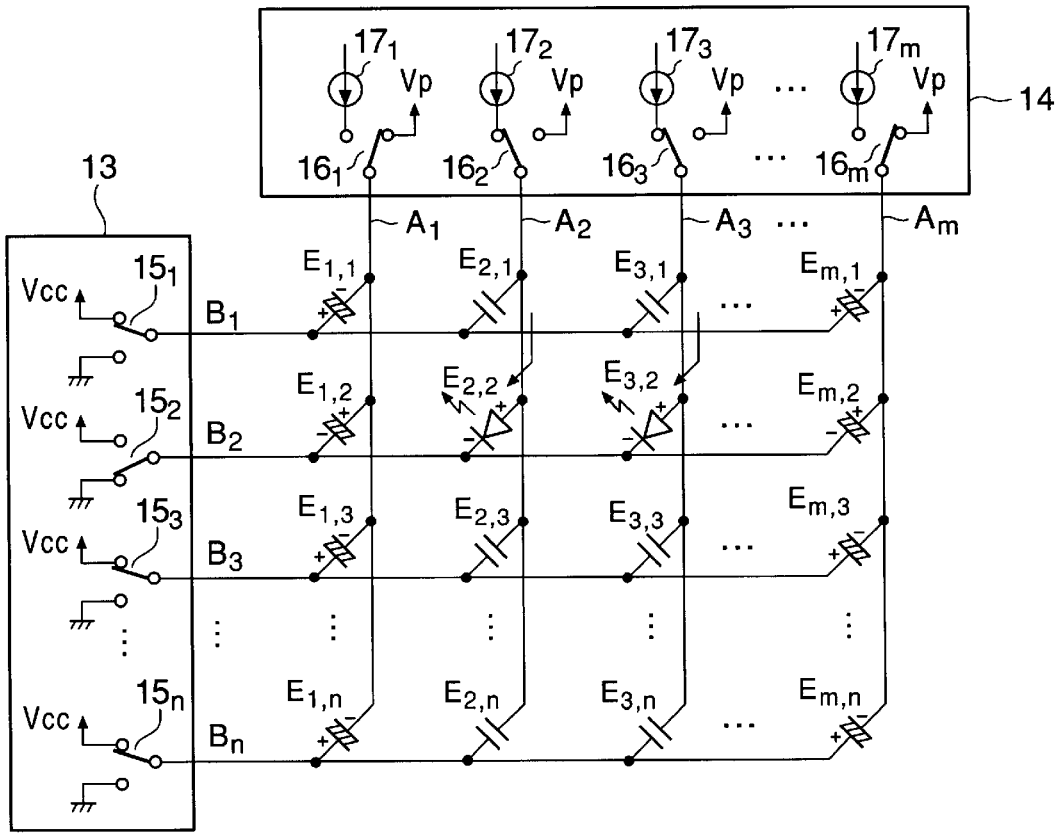

As can be seen in FIGS. 7 and 8, the light emitting panel 11 is configured in a manner similar to that illustrated in FIGS. 3 and 4. Specifically, a plurality of organic electroluminescence elements $E_{i,j}$ ($1 \leqq i \leqq m$, $1 \leqq j \leqq n$) are arranged in matrix at plurality of intersections of anode lines $A_1$ –$A_m$ functioning as drive lines and cathode lines $B_1$ –$B_n$ functioning as scanning lines, and are each connected between associated anode line and cathode line at each of the plurality of intersections of the anode lines $A_1$–$A_m$ with the cathode lines $B_1$–$B_n$.

A cathode line scanning circuit 13 is connected to the cathode lines $B_1$–$B_n$ of the light emitting panel 11, while an anode line drive circuit 14 is connected to the anode lines $A_1$ –$A_m$. The cathode line scanning circuit 13 has scanning switches $\mathbf{15}_1$–$\mathbf{15}_n$ provided in correspondence to the cathode lines $B_1$–$B_n$, respectively. Each of the scanning switches $\mathbf{15}_1$–$\mathbf{15}_n$ selectively supplies a corresponding cathode line with one of a ground potential (first predetermined potential) and a positive potential Vcc (second predetermined potential). The positive potential Vcc is equal to a light emission regulating voltage Ve (Vcc=Ve). As one of the scanning switches $\mathbf{15}_1$–$\mathbf{15}_n$ is in turn switched to output the ground potential in each horizontal scanning period under the control of the light emission control circuit 12, one of the cathode line $B_1$–$B_n$ set at the ground potential functions as a scanning line which enable the elements connected thereto to emit light.

The anode line drive circuit 14 has drive switches $\mathbf{16}_1$–$\mathbf{16}_m$ and current sources $\mathbf{17}_1$–$\mathbf{17}_m$ provided in correspondence to the anode lines $A_1$–$A_m$, respectively. Each of the drive switches $\mathbf{16}_1$–$\mathbf{16}_m$ supplies a corresponding anode line with one of a current from an associated current source and a positive potential Vp (third predetermined potential). The positive potential Vp is lower than the light emission threshold voltage Vth, i.e., Vp<Vth.

The light emission control circuit 12 generates a drive control signal (driving pulse) in accordance with pixel information. The drive control signal is a signal for instructing which of elements connected to associated scanning lines are driven to emit light at which timing and for approximately how long, and is supplied to the anode line drive circuit 14. The anode line drive circuit 14 controls in response to the drive control signal to switch a portion of drive switches $\mathbf{16}_1$–$\mathbf{16}_m$ corresponding to light emission to the current source. Also, The anode line drive circuit 14 supplies associated elements with the driving current in accordance with the pixel information through corresponding ones (designated drive lines) of the anode lines $A_1$–$A_m$, and supplies the remaining anode lines with the positive potential Vp through the associated drive switches.

Figure 6:
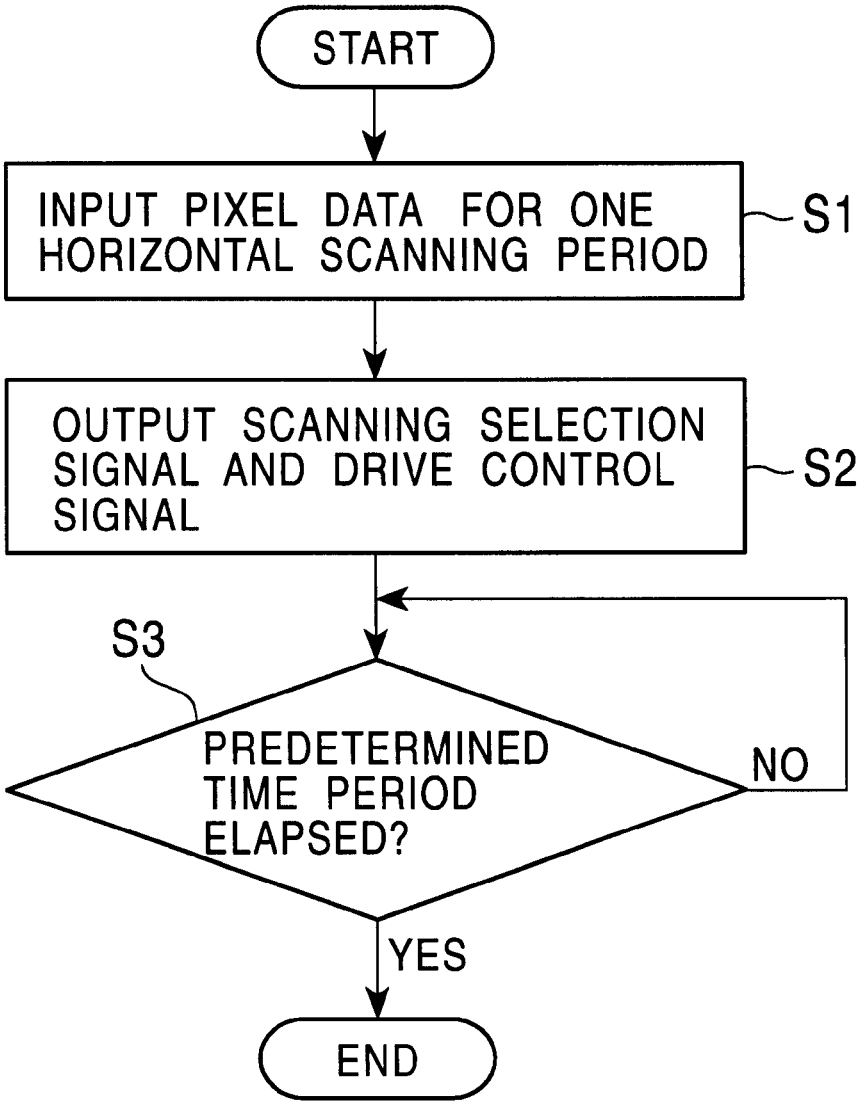
FIG. 6 is a flow chart illustrating a light emission control routine executed by a light emission control circuit.

The light emission control circuit 12 executes a light emission control routine every one horizontal scanning period of supplied pixel data. In the light emission control routine as illustrated in FIG. 6, the light emission control circuit 12 first inputs image data for one horizontal scanning period (step S1), and generates a scanning selection control signal and a drive control signal in accordance with pixel information indicated by the input pixel data for one horizontal scanning period (step S2).

The scanning selection control signal is supplied to the cathode line scanning circuit 13. The cathode line scanning circuit 13 switches to the ground potential a scanning switch (a scanning switch $\mathbf{15}_S$ of $\mathbf{15}_1$–$\mathbf{15}_n$, where S is an integer from one to n) corresponding to one cathode line (scanning line) within the cathode lines $B_1$–$B_n$ for the current horizontal scanning period indicated by the scanning selection control signal, in order to set the cathode line to the ground potential. The remaining scanning switches (all of $\mathbf{15}_1$–$\mathbf{15}_n$, except for the one scanning switch $\mathbf{15}_S$) are switched to the positive potential Vcc in order to apply the remaining cathode lines with the positive potential Vcc.

The drive control signal is supplied to the anode line drive circuit 14. The anode line drive circuit 14 switches to the current source side (corresponding one of $\mathbf{17}_1$–$\mathbf{17}_m$) a drive switch (any of drive switches $\mathbf{16}_1$–$\mathbf{16}_m$) corresponding to an anode line (one drive line) including an E1 element to be driven to emit light within the anode lines $A_1$ –$A_m$ in the current horizontal scanning period indicated by the drive control signal. The remaining anode lines are switched to the positive potential Vp. Thus, for example, when the drive switch $\mathbf{16}_1$ is switched to the current source $\mathbf{17}_1$, a driving current flows from the current source $\mathbf{17}_1$ through the drive switch $\mathbf{16}_1$, the anode line $A_1$ and an EL element $E_{1,S}$, a cathode line $B_S$, a scanning switch $\mathbf{15}_S$, to the ground, so that the element $E_{1,S}$ supplied with the driving current performs light emitting according to the pixel information.

After executing step S2, the light emission control circuit 12 determines whether a predetermined time period has elapsed or not (step S3). The predetermined time period may be, for example, the horizontal scanning period or a time corresponding to the luminance. When the predetermined time has elapsed, the light emission control circuit 12 terminates the light emission control routine, and waits for the next horizontal scanning period to begin. As the next horizontal scanning period begins, the foregoing operations at steps S1–S3 are repeated.

Referring to FIGS. 7 and 8, explained next will be the control operation of the light emission control circuit 12 for scanning the cathode line $B_1$ to drive the elements $E_{1,1}$ and $E_{1,2}$ to emit light, and then scanning the cathode line $B_2$ to drive the elements $E_{2,2}$ and $E_{3,2}$ to emit light. Also, in FIGS. 7 and 8, as is the case with FIGS. 3 and 4, for facilitating the understanding of the explanation, an element which is emitting light is represented by a diode symbol, while an element which is not emitting light is represented by a capacitor symbol.

Referring first to FIG. 7, only a scanning switch 151 is switched to the ground potential equal to zero volt to scan a cathode line $B_1$. The remaining cathode lines $B_2$–$B_n$ are applied with the positive potential VCC through the scanning switches $\mathbf{15}_2$–$\mathbf{15}_n$. Simultaneously, anode lines $A_1$ and $A_2$ are connected to current sources $\mathbf{17}_1$ and $\mathbf{17}_2$ through drive switches $\mathbf{16}_1$ and $\mathbf{16}_2$, respectively. The remaining anode lines $A_3$–$A_m$ are switched to the positive potential Vp through drive switch $\mathbf{16}_3$–$\mathbf{16}_m$. Thus, in the state illustrated in FIG. 7, the EL elements $E_{1,1}$ and $E_{2,1}$ are applied with a forward voltage, so that driving currents flow thereinto from the current sources 171 and 172 as indicated by arrows, causing only the EL elements $E_{1,1}$ and $E_{2,1}$ to emit light.

In the state, the EL elements $E_{3,2}$–$E_{m,n}$ which are not emitting light, indicated by hatching, are applied at their anodes with the positive potential Vp and at their cathodes with the positive potential Vcc. Since Vp<Vcc, each of the EL elements $E_{3,2}$–$E_{m,n}$ is applied with a voltage −Vp+Vcc in the reverse direction, when viewed from the anode side, so that they are charged with the polarities as illustrated in FIG. 7. Each of the EL elements $E_{3,1}$–$E_{m,1}$ on the cathode line $B_1$, which are not emitting light, is applied at the anode with the positive potential Vp and at the cathode with the ground potential. Although each of the EL elements $E_{3,1}$–$E_{m,1}$ is applied with the voltage Vp in the forward direction, when viewed from the anode side, and is charged with the polarities as illustrated in FIG. 7, they do not emit light because of Vp<Vth. While the EL elements are applied with the voltage −Vp+Vcc and charged thereby, the amount of accumulated charge is sufficiently smaller than the amount of accumulated charge by the application of the voltage approximately Vcc as in FIG. 3.

The EL elements $E_{1,2}$–$E_{1,n}$, and $E_{2,2}$–$E_{2,n}$, which are not emitting light, are applied at their anode with a potential equal to the anode potential of the EL element $E_{1,1}$ and $E_{2,1}$ (substantially equal to Ve) and at their cathodes with the positive potential Vcc, so that these EL elements are not charged as illustrated in FIG. 7.

As the next horizontal scanning period begins from the state illustrated in FIG. 7 where the EL elements $E_{1,1}$ and $E_{2,1}$ are emitting light, only the scanning switch 152 corresponding to the cathode line $B_2$ is next switched to the ground potential equal to zero volt to scan the cathode line $B_2$ as illustrated in FIG. 8. Simultaneously with this, the drive switches $\mathbf{16}_2$ and $\mathbf{16}_3$ are switched to the current sources $\mathbf{17}_2$ and $\mathbf{17}_3$, respectively, so that they are connected to corresponding anode lines. Also, the remaining drive switches $\mathbf{16}_1$, $\mathbf{16}_4$–$\mathbf{16}_m$ are switched to the positive potential Vp to apply the positive potential Vp to the anode lines $A_1$, $A_4$–$A_m$. Thus, in the state illustrated in FIG. 8, the elements $E_{2,2}$ and $E_{3,2}$ are applied with the voltage in the forward direction so that the driving currents flow thereinto from the current sources $\mathbf{17}_2$ and $\mathbf{17}_3$ as indicated by arrows, thereby causing only the EL elements $E_{2,2}$ and $E_{3,2}$ to emit light.

In the light emitting state, EL elements $E_{1,1}$, $E_{1,3}$–$E_{1,n}$, $E_{4,1}$–$E_{m,1}$ and $E_{4,3}$–$E_{m,n}$, which are not emitting light, indicated by hatching, are applied at their anodes with the positive potential Vp and at their cathode with the positive potential Vcc. Since Vp<Vcc, the EL elements $E_{1,1}$, $E_{1,3}$–$E_{1,n}$, $E_{4,1}$–$E_{m,1}$ and $E_{4,3}$–$E_{m,n}$ are applied with a voltage −Vp+Vcc, when viewed from the anode side, so that they are charged again with the polarities as illustrated in FIG. 8. Although these elements are applied with the voltage −Vp+Vcc and charged thereby, the amount of accumulated charge is sufficiently smaller than the amount of accumulated charge by the application of the voltage approximately Vcc as in FIG. 3. E1 elements $E_{4,3}$–$E_{m,n}$ are continuously charged.

Although the EL elements $E_{1,2}$ and $E_{4,2}$–$E_{m,2}$ on the cathode line $B_2$, which are not emitting light, are applied at their anodes with the positive potential Vp and at their cathodes with the ground potential, they do not emit light because of Vp<Vth. Each of the EL elements $E_{1,2}$ and $E_{4,2}$–$E_{m,2}$ is applied with the voltage Vp, when viewed from the anode side, and is charged again with the polarities illustrated in FIG. 8. Also, since the EL elements $E_{2,1}$, $E_{2,3}$–$E_{2,n}$, $E_{3,1}$ and $E_{3,3}$–$E_{3,n}$, which are not emitting light, are applied at their anodes with a potential equal to the anode potential of the EL elements $E_{2,2}$ and $E_{3,2}$ (substantially equal to Ve) and at their cathodes with the positive potential Vcc, these elements are not charged as illustrated in FIG. 8. Since the EL elements $E_{3,1}$ and $E_{3,3}$–$E_{3,n}$ have accumulated charges illustrated in FIG. 7 until the scanning of the cathode line $B_2$ is started, the charges will be immediately discharged.

The E1 element $E_{3,2}$, which emit light by scanning the cathode line $B_2$, is applied with a voltage −Vp+Vcc in the reverse direction and charged thereby while the cathode line $B_1$ is being scanned. However, the amount of accumulated charge is sufficiently smaller than the amount of accumulated charge by the application of the voltage approximately Vcc as in FIG. 3. Thus, when the scanning of the cathode line $B_2$ is started, the charge so far accumulated on the EL element $E_{3,2}$ is promptly discharged immediately after the EL element $E_{3,2}$ is applied with a forward voltage, so that a driving current flows thereinto from the current source $\mathbf{17}_3$ as indicated by an arrow, causing the EL element $E_{3,2}$ to emit light. It is therefore possible to improve the light emission starting characteristic.

As described above, while the EL elements are each applied with a reverse voltage −Vp+Vcc and charged thereby in order to prevent light emission which causes crosstalk, the amount of accumulated charge by this charging is sufficiently small, so that it is possible to reduce power consumption that does not contribute to light emission more than the prior art apparatus when performing the same light emitting operations as those illustrated in FIGS. 3, 4 and FIGS. 7, 8.

In the foregoing embodiment, the first predetermined potential is chosen to be the ground potential; the second predetermined potential, the positive potential Vcc; and the third predetermined potential, the positive potential Vp. The present invention, however, is not limited to these potential levels, as long as the second predetermined potential is higher than the first predetermined potential, and the third predetermined potential is lower than a light emission threshold voltage and higher than the first predetermined potential.

Also, while a driving current is supplied from a current source to an EL element driven to emit light, an appropriate potential may be applied from a voltage source to designated drive lines such that the EL element is applied with a forward voltage which is slightly higher than the light emission threshold voltage.

As described above, according to the present invention, it is possible to reduce power consumption that does not contribute to light emission, and improve the light emission starting characteristic.

What is claimed is:

1. An apparatus for driving a light emitting panel including a plurality of drive lines and a plurality of scanning lines intersecting with each other, and a plurality of capacitive light emitting elements each having a polarity and connected between one of said scanning line and one of said drive line at an intersecting position of said one scanning line and said one drive line, said driving apparatus comprising:

control means for selecting one scanning line from said plurality of scanning lines in accordance with a scanning timing of an input video data, and for designating at least one drive line of said plurality of drive lines corresponding to at least one capacitive light emitting element driven to emit light on said one scanning line in accordance with said input video data;

means for applying said one scanning line with a first predetermined potential, and for applying scanning lines other than said one scanning line with a second predetermined potential higher than said first predetermined potential; and means for supplying a driving current to said at least one drive line so as to apply said at least one capacitive light emitting element with a positive voltage equal to or higher than a light emission threshold voltage in a forward direction during a scanning period when the first predetermined potential is applied to said one scanning line, and for applying drive lines other than said at least one drive line with a third predetermined voltage lower than said light emission threshold voltage and higher than said first predetermined potential during the scanning period.

2. A driving apparatus according to claim 1, wherein said first predetermined potential is a ground potential, and said second predetermined potential is substantially equal to a light emission regulating voltage.

3. A driving apparatus according to claim 1, wherein said driving current is supplied from a current source.

4. A driving apparatus according to claim 1, wherein said capacitive light emitting elements are organic electroluminescence elements.

5. A method of driving a light emitting panel including a plurality of drive lines and a plurality of scanning lines intersecting with each other, and a plurality of capacitive light emitting elements each having a polarity and connected between one of said scanning line and one of said drive line at an intersecting position of said one scanning line and said one drive line, said driving method comprising the steps of:

selecting one scanning line from said plurality of scanning lines in accordance with a scanning timing of an input video data;

designating at least one drive line of said plurality of drive lines corresponding to at least one capacitive light emitting element driven to emit light on said one scanning line in accordance with said input video data;

applying said one scanning line with a first predetermined potential;

applying scanning lines other than said one scanning line with a second predetermined potential higher than said first predetermined potential;

supplying a driving current to said at least one drive line so as to apply said at least one capacitive light emitting element with a positive voltage equal to or higher than a light emission threshold voltage in the forward direction during a scanning period when the first predetermined potential is applied to said one scanning line; and applying drive lines other than said at least one drive line with a third predetermined voltage lower than said light emission threshold voltage and higher than said first predetermined potential during the scanning period.

* * * * *